US005778976A

United States Patent [19]

Murray

[11] Patent Number: 5,778,976

[45] Date of Patent: Jul. 14, 1998

[54] CASING INSTALLATION EQUIPMENT

[75] Inventor: Geoffrey Neil Murray, New Plymouth, New Zealand

[73] Assignee: Austoil Technology Limited, Auckland, New Zealand

[21] Appl. No.: 693,177

[22] PCT Filed: Feb. 14, 1995

[86] PCT No.: PCT/NZ95/00012

§ 371 Date: Aug. 14, 1996

§ 102(e) Date: Aug. 14, 1996

[87] PCT Pub. No.: WO95/21986

PCT Pub. Date: Aug. 17, 1995

[30] Foreign Application Priority Data

Feb. 14, 1994 [NZ] New Zealand ..... 250867

[51] Int. Cl.[6] ..... E21B 17/10

[52] U.S. Cl. ..... 166/241.6; 166/241.7; 166/242.1; 175/325.5

[58] Field of Search ..... 166/166, 173, 166/241.1, 241.2, 241.3, 241.4, 241.6, 241.7, 242.1, 242.8; 175/325.1, 325.3, 325.5

[56] References Cited

U.S. PATENT DOCUMENTS

| | | | |
|---|---|---|---|
| 2,998,848 | 9/1961 | Wright et al. | 166/241.6 |
| 3,196,952 | 7/1965 | Solum | 166/241.7 |
| 4,190,123 | 2/1980 | Roddy . | |
| 4,620,802 | 11/1986 | Harrel | 166/241.3 X |
| 4,747,452 | 5/1988 | Clark | 166/241.1 X |
| 4,779,678 | 10/1988 | White | 166/241.3 |
| 5,033,558 | 7/1991 | Russo et al. | 175/325.3 |
| 5,522,467 | 6/1996 | Stevens et al. | 175/325.5 X |

FOREIGN PATENT DOCUMENTS

| | | | |
|---|---|---|---|
| 2 275 284 | 8/1994 | United Kingdom . | |
| 9324728 | 12/1993 | WIPO | 166/241.1 |

OTHER PUBLICATIONS

Abstract for SU 1810474–A1, dated Feb. 9, 1990.
Abstract for SU 1719616–A1, dated Feb. 5, 1990.
PCT International Application No. PCT/US94/02974, Filed 18 Mar. 1994.
PCT International Application No. PCT/US86/01044, Filed 13 May 1986.

*Primary Examiner*—George A. Suchfield
*Attorney, Agent, or Firm*—Merchant, Gould, Smith, Edell, Welter & Schmidt, P.A.

[57] ABSTRACT

Improvements in casing installation components are described. The modified construction comprises radial support pedestals (2) incorporating rollers (3) on the outside of the support pedestals so that the rollers reduce longitudinal friction between the component and the well bore. The improvements described may be adapted for use in the construction of casing centralizers, float shoes, float collars and similar equipment which is inserted into the well bore.

20 Claims, 4 Drawing Sheets

CASING INSTALLATION EQUIPMENT

FIELD OF THE INVENTION

The present invention relates to the construction of oil, gas, geothermal or other wells having a casing inserted into the well bore, and cemented into place. More particularly, but not exclusively, the present invention relates to improvements in casing installation equipment which may find application in the construction of centralizers, float shoes and float collars.

BACKGROUND OF THE INVENTION

The improvements in casing installation equipment described herein may find application in the construction of float collars, float shoes and such related components as are used in casing installation. The details of such improvements are discussed below with particular reference to casing centralizers, although it is understood that such techniques may be applied to the abovementioned related components.

When the drilling stage of a well is completed a casing string is lowered into the bore of the well. The casing serves to prevent the collapse of unstable portions of the formation through which the well is being drilled, provide a smooth bore through which the production fluids and/or gas may flow and prevent pressure loss and/or fluid and gas migration between zones.

The casing is secured within the well bore by cementing. In this process, a cement slurry is pumped downward into the casing and up within the annular volume created between the casing outer wall and the bore surface. It is essential that the cement provides a uniform shell of substantially constant thickness surrounding the casing. To this end, adequate stand-off must be maintained between the bore wall and the outside surface of the casing.

In practice, it is virtually impossible to produce a well bore which is perfectly straight. A consequence of this being that the casing frequently rests against the bore wall over portions of the well length. This problem is further exacerbated when drilling volcanic formations in which large hard rock intrusions ("ghoulies") are encountered. In this latter case the drill string departs from the vertical, thereby forming a deviated bore path through which the casing string must pass.

If insufficient stand-off is maintained, the upward flow of the cement slurry is impeded thus increasing the likelihood of forming cavities in the cement. Such voids can lead to the undesireable migration of gas or fluid from one zone to another. In some instances catastrophic failure of the well can result from migration of high pressure gas or fluid up the outside of the casing due to inadequate cement placement.

To provide the required degree of standoff, casing centralizers spaced apart at regular intervals along the casing string, are used to hold the casing in the center of the well bore.

Casing centralizers are generally constructed in the form of a metal cage incorporating two end collars with an internal diameter such that the casing fits closely within the bore of the centralizer collars. The two collars are connected longitudinally by bow springs thereby forming a cylindrical cage which holds the casing off from the formation via the resilient action of the bow springs.

Bow spring centralizers can fail in situations where pronounced well deviations produce lateral forces which compress the bow springs sufficiently to allow the casing to lie against the well bore. In this situation, inadequate standoff may produce cement voids leading to failures as described above. In addition, the relatively flimsy construction of such centralizers can result in mechanical failures and/or jamming under conditions often encountered downhole, such as passing through key seats. A further disadvantage of bow spring centralizers is that they exhibit high axial drag or "starting force" due to the sustained tension of each bow spring against the wall of the well bore.

An alternative type of centralizer commonly used incorporates rigid metal strips tapering at each end which replace the resilient bow springs discussed above. Centralizers of this type are rigid in construction and lend themselves to cast manufacturing techniques. The collars may extend over the entire length of the centralizer thereby forming an enclosed cylinder with solid metal stand-off elements which are cast integrally or attached separately. This type of centralizer, while providing positive casing standoff can also produce high frictional loads when 'running' the casing into the well. These frictional loads, while lower than for a bow spring centralizer, can pose a significant problem in high displacement deviated and horizontal wells with there being many instances where the well could not be properly cased. This type of centralizer, when cast in aluminium or other soft materials, is prone to wear whilst in use leading to potential loss of standoff and consequent inferior cementation.

Many currently available centralizers exhibit hydrodynamic shortcomings including: high pressure drop; high turbulence without enhancing cementation; and a tendency to induce cement 'roping' due to excessive turbulence and/or wide exit transitions.

Casing centralizers are generally secured to the casing at the junction of two casing sections. However, there is no strict requirement that the centralizer be located at this position and they may be located at any point along the casing string.

Centralizers are secured to the casing string via stop collars located above and/or below the centralizer body or they may be attached directly to the casing using set screws incorporated into the centralizer itself. In the latter case the centralizer is fixed axially and longitudinally and in the former it is free to rotate thereby aiding penetration downhole.

Float collars are collars screwed onto the casing string and usually connect the lowermost length of casing to the rest of the string. They contain one of more valves which normally may be operated by remote means by the drilling crew at the surface.

A float shoe is similar to a float collar except that it is screwed to the bottom of the lowermost length of the casing.

It is an object of the present invention to provide casing installation equipment which at least alleviates the abovementioned problems, or to at least provide the public with a useful choice.

SUMMARY OF THE INVENTION

In one aspect this invention provides for improved casing installation components comprising:

a component body;

a plurality of support pedestals protruding from the outer surface of said body positioned so that the casing is held substantially in the centre of the well bore, friction reducing means mounted in banks in axially and peripherally spaced relation on the outer surface of at least some of the support pedestals and adapted to reduce resistance to axial movement of the component and consequently the casing string through the well bore.

Preferably the support pedestals are, in plan, tear-drop shaped and taper towards their outer surface whereby the outer surface generally conforms to a cylinder having a central axis coincident with that of the body.

Preferably the friction reducing means comprises one or more rollers mounted via a roller securing means on the surface of or partially recessed into each support pedestal.

Preferably each roller may comprise one or more cylinders.

Most preferably each roller may comprise one or more tapering cylinders and/or barrels constructed and arranged so as to present a surface in contact with the well bore which is substantially congruent to the cross sectional shape of the well bore.

Preferably each roller may have an axis of rotation substantially perpendicular to the axis of the centralizer body and parallel to the support pedestal surface.

Preferably the roller securing means comprises a pin inserted through a bore machined into the support pedestal arranged so as to pass through a bore machined in the roller or rollers Preferably the centralizer incorporates a securing means by which the centralizers longitudinal movement in relation to the drill string is substantially constrained.

Preferably the securing means comprise set screws or the like incorporated into the body of the centralizer.

Preferably the component is a float collar.

Preferably the component is a float shoe.

According to a further aspect there is provided an improved casing installation component comprising:

a component body;

a plurality of support pedestals protruding from the outer surface of said body being substantially tear-drop shaped in the axial direction of the body and positioned so that the casing is held substantially in the centre of the well bore;

friction reducing means mounted on the outer surface of at least some of the support pedestals and adapted to reduce the resistance to axial movement of the component and subsequently the casing string through the well bore.

The exemplary embodiment which follows is directed toward the particular application of the invention in the construction of a casing centralizer.

It is to be understood that the invention may be described in the context of other installation equipment detailed above, and is in no way restricted to the particular example which follows.

BRIEF DESCRIPTION OF THE DRAWINGS

An embodiment of the invention is now described by way of example in which.

DETAILED DESCRIPTION OF THE PREFERRED EMBODIMENT

Figure 1A:
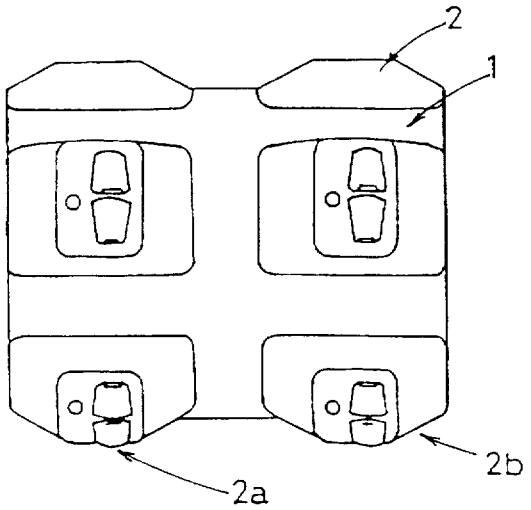
FIGS. 1A and 1B illustrate a side and end elevation respectively, of a possible configuration of a roller centralizer.
Figure 1B:
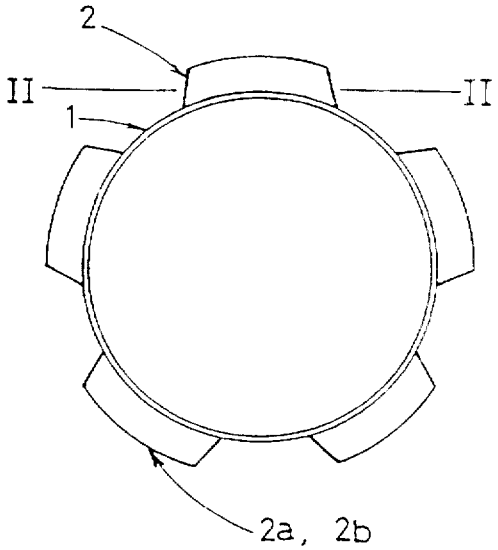
Figure 3:
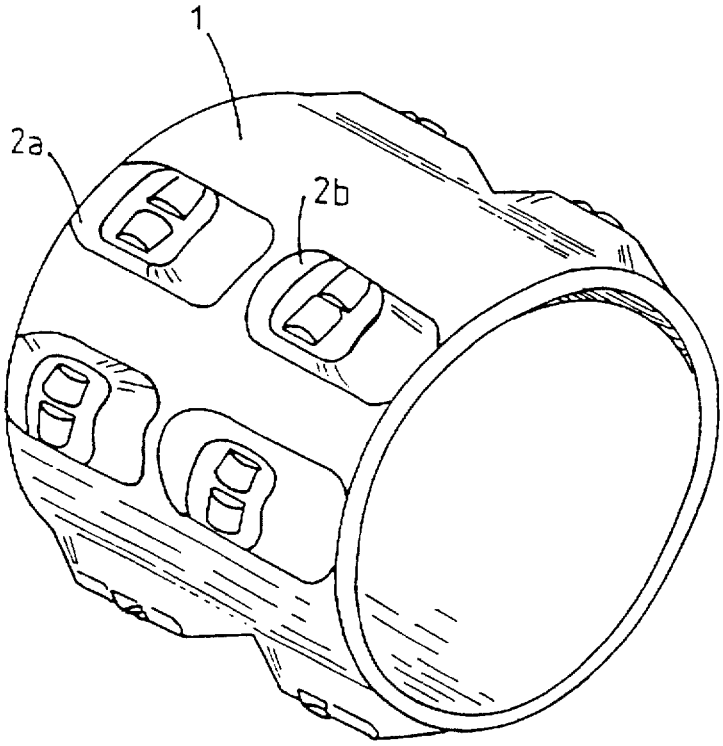
FIG. 3. illustrates a perspective view of the centralizer shown in FIGS. 1 and 2.
Figure 4:
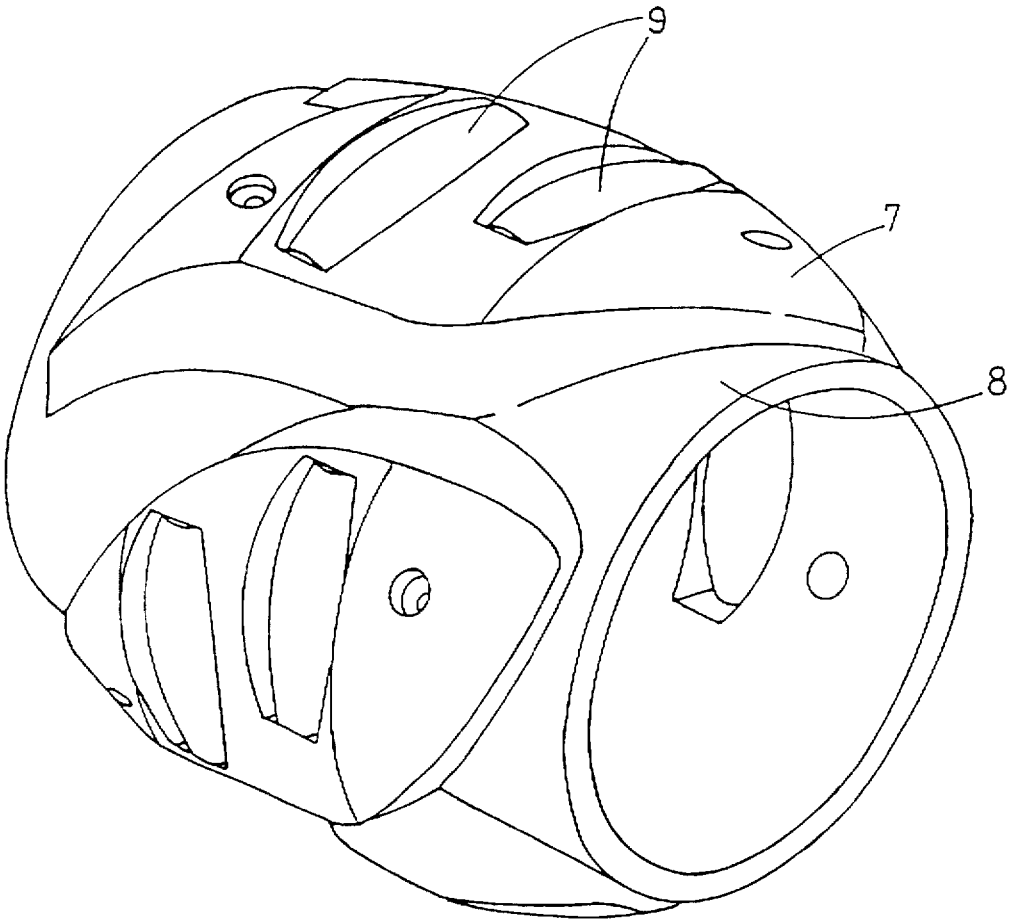
FIG. 4. illustrates an alternative embodiment having tear-drop shaped pedestals.
Figure 5:
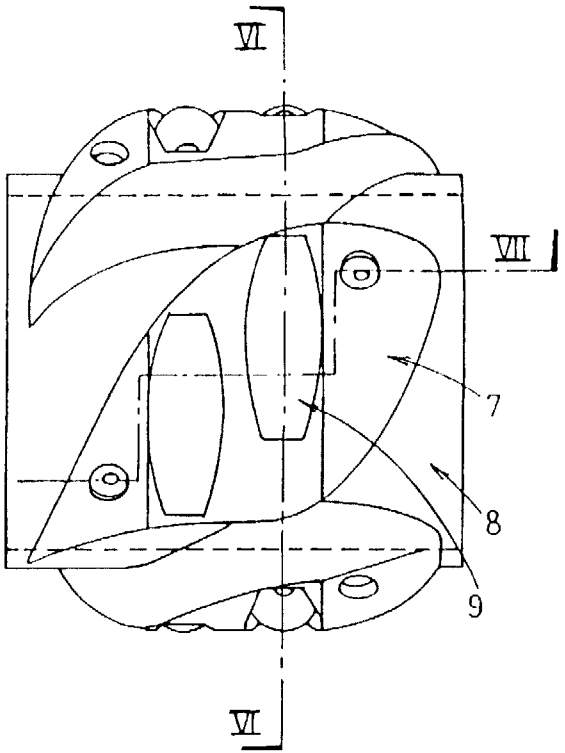
FIG. 5 illustrates a side view of the centralizer shown in FIG. 4.
Figure 7:
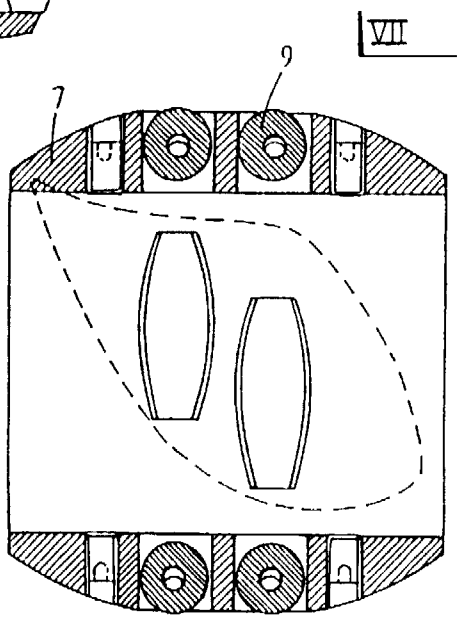
FIG. 7 shows a cross-sectional view of the centralizer shown in FIG. 5 through line VII—VII.
Figure 6:
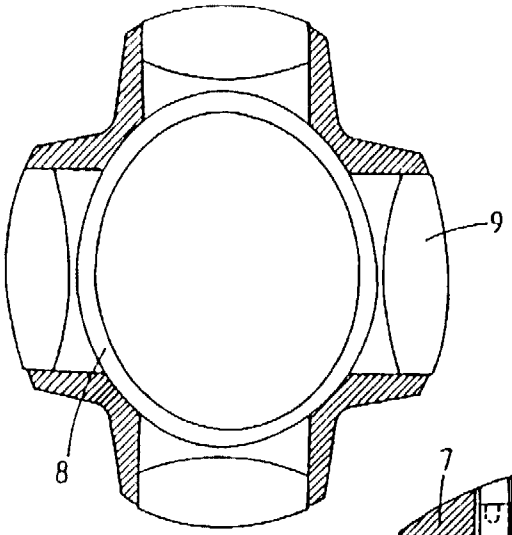
FIG. 6 shows a cross-sectional view through line VI—VI of the centralizer shown in FIG. 4.

Referring to FIGS. 1A, 1B and 3, a roller centralizer 10 is shown. The centralizer body 1, is of a tubular form with a smooth bore with an internal diameter such that it fits snugly around the casing string. In use, the centralizer is positioned at either a casing joint or at a point between casing joints.

The roller centralizer is secured to the casing string (not shown) via a stop collar (not shown) positioned immediately above and/or below the roller centralizer. Any stop collars well known in the art may be used, such as collars in the form of rings incorporating set screws or compression means by which the stop collar is compressed around the circumference of the casing thus relying on friction to resist movement along the longitudinal axis of the casing string. Thus the roller centralizer is free to rotate around the casing but is constrained to a fixed position along the axis of the casing string.

It is also contemplated that the roller centralizer itself may incorporate securing means such as in the form of set screws adapted to fix the roller centralizer to the casing thereby inhibiting any rotational or longitudinal movement.

An advantage of allowing the roller centralizer to rotate with respect to the casing string is that in deviated wells a degree of casing rotation may be required to penetrate to the well bottom.

The roller centralizer body 1 is formed from rigid material satisfying the criteria of corrosion resistance and extreme durability (eg: a metal). To this end a solid cast construction is employed preferably using a ductile nodular iron. However, it is envisaged that other materials such as injection moulded plastics or carbon fibre may be suitable depending on cost and ease of manufacture.

Figure 2:
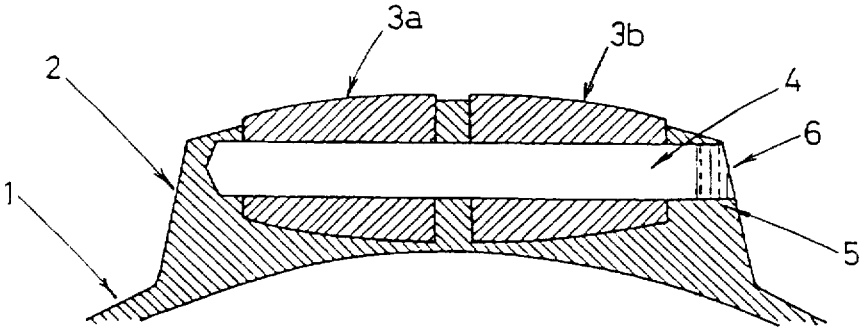
FIG. 2. illustrates a detail of the roller and support pedestal along line II—II.

Support pedestals 2 can be formed integrally with the roller centralizer body 1. As shown in FIG. 2, these pedestals are of a radial dimension such that sufficient stand-off is maintained between the casing string and the well bore.

Roller assembly 3 comprising two tapered rollers 3*a* and 3*b* is mounted in recesses in the surface of the support pedestal by means of pin 4 inserted sideways through a bore 5 machined in the support pedestal and the bore of the rollers.

The pin 4 is constrained within the bore 5 by means of a brazed or arc welded infill 6.

It is envisaged that the rollers may be constructed of metal. However, it is contemplated that other materials such as thermoplastics may be used.

The cross sectional shape of the rollers 3*a* and 3*b* is such that they conform to the internal surface of the well bore, thereby allowing the centralizer in conjunction with the casing string, to pass freely through the well bore.

In use, cement is pumped down the outside of the casing string. The pedestals are spaced apart in such a configuration on to allow the cement to flow downward to fill the volume between the casing and well bore completely. It is desirable that a degree of turbulent flow be maintained in the cement to enhance cementation, however under some conditions cement "roping" may occur resulting in cavities which can lead to casing failure as discussed above. To avoid this problem, it is envisaged that the pedestals may be tear-drop in shape, thus presenting a hydrodynamically smooth obstacle around which the cement must flow. An example of such a pedestal configuration is shown in FIGS. 4 to 7. The tear-drop shaped pedestals 7 lie parallel to a helix on the surface of the casing body 8 and producing a "fling" effect on the surface of the roller centralizer.

The rollers 9 are shaped so as to be accommodated in the particular pedestals configuration shown. It is to be understood that the roller position is not limited to that shown and other arrangements may be suitable.

The pedestal shape shown has been found to be particularly suitable, however, it is envisaged that a variety of pedestal cross-sections could be employed to provide a similar result depending on the conditions.

It is envisaged that other roller configurations are possible, such as roller elements comprising single hollow untapered cylinders, secured in a single recess in a manner similar to that described above. However, it has been found that the tapered roller configuration illustrated in FIG. 2 when compared to the solid centralizer without rollers as described above, has reduced the estimated coefficient of friction from 0.45 to 0.05—an approximately tenfold decrease.

It is anticipated that the means by which the pins 4 are secured in the support pedestals may include peened over pins, nuts, bolts, circlips, and split pins. However, these constructions are considered less reliable than the securing method shown in FIG. 2.

The distribution and number of the support pedestals on the surface of the roller centralizer body is generally as shown in FIG. 1, namely five pairs of pedestals spaced radially around the body surface, and each pair 2*a* and 2*b* aligned parallel with the roller centralizer body axis. However, any configuration which may be contemplated will be a compromise between the desired reduction in the running in friction and the hydrodynamic efficiency of the centralizer when pumping in the cement slurry.

Accordingly, other arrangements and numbers of pedestals are anticipated without departing from the principles of the novel technique of reducing the running in friction at the interface between the support pedestal and the well bore.

It is to be understood that the construction described above may be adapted to float shoes, float collars and other related items of casing installation equipment, where it is desirable to minimize running in friction.

The improved casing installation equipment may find application in a variety of drilling situations such as gas, geothermal and oil.

It is particularly suitable in situations where a casing string is to be lowered into a well bore thereby providing a conduit through which production fluids may pass thereby avoiding pressure loss and/or migration between zones.

Accordingly, it is to be understood that the scope of the invention is not limited to the described embodiment and therefore that numerous variations and modifications may be made to this embodiment without departing from the scope of the invention as set out in this specification.

I claim:

1. An improved casing installation component comprising:

a component body having a bore therethrough along a central axis thereof to enable rotation of the component about a drill string;

a plurality of support pedestals protruding from the outer surface of said body, positioned so that in use the casing is held substantially in the center of a well bore;

friction reducing means mounted in banks in axially and peripherally spaced relation on the outer surface of at least some of the support pedestals and adapted to reduce the resistance to axial movement of the component and subsequently the casing string through the well bore.

2. An improved casing installation component as claimed in claim 1 wherein the pedestals are of a shape adapted to minimize the turbulence resulting from axial fluid flow past the exterior of the component.

3. An improved casing installation component as claimed in claim 1 wherein the friction reducing means comprise a plurality of rollers.

4. An improved casing installation component comprising:

a component body;

a plurality of support pedestals protruding from the outer surface of said body being substantially tear-drop shaped in the axial direction of the body and positioned so that in use the casing is held substantially in the center of a well bore;

friction reducing means mounted on the outer surface of at least some of the support pedestals and adapted to reduce the resistance to axial movement of the component and subsequently the casing string through the well bore.

5. An improved casing installation component as claimed in claim 4 wherein the friction reducing means comprises one or more rollers mounted via a roller securing means on the surface of or partially recessed into each support pedestal.

6. An improved casing installation component as claimed in claim 3 wherein each roller is of a substantially cylindrical shape.

7. An improved casing installation component as claimed in claim 5 wherein each roller comprises one or more tapering cylinders and/or barrels constructed and arranged so as to present a surface in contact with the well bore which is substantially congruent to the cross sectional shape of the well bore.

8. An improved casing installation component as claimed in claim 5 wherein each roller has an axis of rotation substantially perpendicular to the axis of the component body and parallel to the support pedestal surface.

9. An improved casing installation component as claimed in claim 4 wherein axes of the tear-drop shaped pedestals lie at an angle to the axial direction of the body.

10. An improved casing installation component as claimed in claim 5 wherein the roller securing means comprises a pin inserted through a bore machined into the support pedestal arranged so as to pass through a bore machined in the roller or rollers.

11. An improved casing installation component as claimed in claim 4 wherein the component incorporates a securing means by which the components longitudinal movement in relation to the drill string is substantially constrained.

12. An improved casing installation component as claimed in claim 4 wherein said component is a casing centralizer.

13. An improved casing installation component as claimed in claim 4 wherein said component is a float shoe.

14. An improved casing installation component as claimed in claim 2 wherein the friction reducing means comprise a plurality of rollers.

15. An improved casing installation component as claimed in claim 5 wherein each roller is of a substantially cylindrical shape.

16. An improved casing installation component as claimed in claim 6 wherein each roller comprises one or more tapering cylinders and/or barrels constructed and arranged so as to present a surface in contact with the well bore which is substantially congruent to the cross sectional shape of the well bore.

17. An improved casing installation component as claimed in claim 5 wherein each roller is of a substantially cylindrical shape.

18. An improved casing installation component as claimed in claim 3 wherein each roller has an axis of rotation substantially perpendicular to the axis of the component body and parallel to the support pedestal surface.

19. An improved casing installation component as claimed in claim 1 wherein said component is a casing centralizer.

20. An improved casing component as claimed in claim 1 wherein said component is a float shoe.

* * * * *